US005565741A

United States Patent [19]

Jennato et al.

[11] Patent Number: 5,565,741

[45] Date of Patent: Oct. 15, 1996

[54] METHOD OF OPERATING A NEON DISCHARGE LAMP PARTICULARLY USEFUL ON A VEHICLE

[75] Inventors: Scott D. Jennato, Candia; Harold L. Rothwell, Jr., Hopkinton, both of N.H.; Robert H. Colburn, Groveland, Mass.

[73] Assignee: Osram Sylvania Inc., Danvers, Mass.

[21] Appl. No.: 213,649

[22] Filed: Mar. 16, 1994

[51] Int. Cl.[6] ..... H05B 41/16

[52] U.S. Cl. ..... 315/246; 315/77; 313/572; 313/576

[58] Field of Search ..... 315/77, 246; 313/572, 313/576

[56] References Cited

U.S. PATENT DOCUMENTS

| | | | |
|---|---|---|---|
| 3,848,248 | 11/1974 | MacIntyre, Jr. | 345/60 |
| 4,461,981 | 7/1984 | Saikatsu et al. | 315/246 |
| 4,645,979 | 2/1987 | Chow | 315/169.1 |
| 4,695,152 | 9/1987 | Urso, Jr. | 313/572 |
| 4,792,727 | 12/1988 | Godyak | 315/176 |
| 4,937,497 | 6/1990 | Osawa et al. | 315/77 |
| 5,072,155 | 12/1991 | Sakorai et al. | 315/219 |

*Primary Examiner*—Benny Lee
*Assistant Examiner*—Darius Gambino
*Attorney, Agent, or Firm*—William E. Meyer

[57] ABSTRACT

An method of operating a neon stop lamp for a vehicle is described. By adjusting the lamp pressure, the then controlling the frequency and pulse width of the power, the lamp efficiency can be increased, while also shifting the chromaticity for the lamp to comply with automotive standards. The result is a small, efficient light source whose light may be reflected and focused, and whose color is correct for vehicle warning lights.

21 Claims, 6 Drawing Sheets

METHOD OF OPERATING A NEON DISCHARGE LAMP PARTICULARLY USEFUL ON A VEHICLE

TECHNICAL FIELD

The invention relates to electric lamps and particularly to rare gas discharge lamps. More particularly the invention is concerned with a method of operating a neon gas discharge lamp.

BACKGROUND ART

Vehicle stop lights are commonly tungsten filament lamps positioned in a reflector, and behind a red lens. The reflector directs all or most of the light through the lens, where only the red portion of the light is transmitted. Filtering inherently reduces the energy efficiency of the design. The typical taillamp, shows a hot spot where the white lamp overpowers the red filter. Away from the hot spot, the light appears less white or yellow, and becomes redder, but at the same time becomes less intense. The typical vehicle stop lamp then varies across its face in color and intensity. These variations are felt to be unesthetic by vehicle designers. There is then a general need for an efficient vehicle stop lamp, and a specific need for a vehicle stop lamp with an even distribution of color and intensity.

Neon lamps are known to produce red light, and therefore offer the opportunity of an unfiltered vehicle stop lamp. There are however problems to be overcome. Typical neon sign lamps use long tubes about one or two centimeters in diameter, that contain the diffused gaseous neon plasma light source. These lamps typically have inputs from 1100 to 1200 volts, at a few milliamps of power. These lamps give off a diffuse, low intensity light that has a chromaticity that does not meet automotive standards. For proper visibility, the light must be reflected and focused to concentrated it down the road, but a diffuse light source with a diameter one fir two centimeters cannot be efficiently reflected or focused. There is then a need for a small diameter, high intensity, neon stop lamp.

Narrow tube neon lamps are known. These lamps may have tube diameters of several millimeters, and have small electrodes providing very low output wattages. These lamps are used in artistic signs meant to be viewed at only a few feet. The small diameter tubes do not produce enough light to be sufficiently visible for vehicle use. Alternatively, a narrow central tube can be connected to broad end sections enclosing heavy electrodes. The larger electrodes provide increased power, without undue electrode erosion, but the large electrodes form large dark spots at each lamp end. The large, and dark electrode ends are felt to be unesthetic by vehicle designers.

The SAE has determined a particular red that is preferred for stop and warning illumination. Typical neon sign lamps are too orange to satisfy the SAE requirement, so there is a need for a neon lamp whose color meets the SAE chromaticity requirements. Typical neon lamps include mercury to simplify starting, but mercury based lamps do not start easily in cold environments. There is then a need for a mercury free neon lamp that meets SAE color requirements.

Examples of the prior art are shown in the following U.S. patents:

U.S. Pat. No. 2,123,709, issued to L. J. Bristow et al on Jul. 12, 1938 for a Therapeutic Light Ray Apparatus shows narrow, folded over neon tube for therapeutically probing body cavities.

U.S. Pat. No. 2,874,324, issued to G. F. Klepp et al on Feb. 17, 1959 for Electric Gaseous Discharge Tubes shows a neon discharge device having a pressure of about 25 millimeters of mercury. By choosing the envelope size and lamp pressure, the voltage regulation of the device can be optimized to offset temperature induced response variations in the device.

U.S. Pat. No. 4,792,727, issued to Valery A. Godyak on Dec. 20, 1988 for a System and Method for Operating a Discharge Lamp to Obtain Positive Volt-Ampere Characteristic shows a gas discharge lamp operated with a base electron heating current, and an additional pulsed ionization current occurring faster than the diffusion time of the gas, said to be typically about 1 microsecond. A driving wave with a frequency of 3333 Hertz and a pulse width of 1 microsecond is suggested. A lamp is operated at 264 milliamps.

U.S. Pat. No. 5,072,155, issued to Takehiko Sakurai et al. on Dec. 10, 1992 for Rare Gas Discharge Fluorescent Lamp Device discloses a copying machine lamp with high brightness and efficiency. Sakuria suggests in a xenon, argon, or krypton gas filled lamp, the use of a pulsed power supply wherein the pulse period is less than 150 microseconds, and the cycle period is greater than 5% of the pulse to avoid sputtering deterioration of the electrodes, and less than 70% of the pulse period to maximize light output for energy input. The gases discharge ultraviolet light that stimulates a fluorescent coating to produce visible light.

DISCLOSURE OF THE INVENTION

A neon vehicle stop lamp with an inner diameter less than or equal to 5 millimeters, and pressurized to from 50 to 220 torr of neon, may be efficiently operated by supplying pulsed direct current at a frequency from 10 to 20 (or more) kilohertz, with a pulse time duration from 5 to 20 microseconds to produce visible light, while allowing the chromaticity of the light to remain in the proper region of red for vehicle lighting.

BEST MODE FOR CARRYING OUT THE INVENTION

Figure 1:
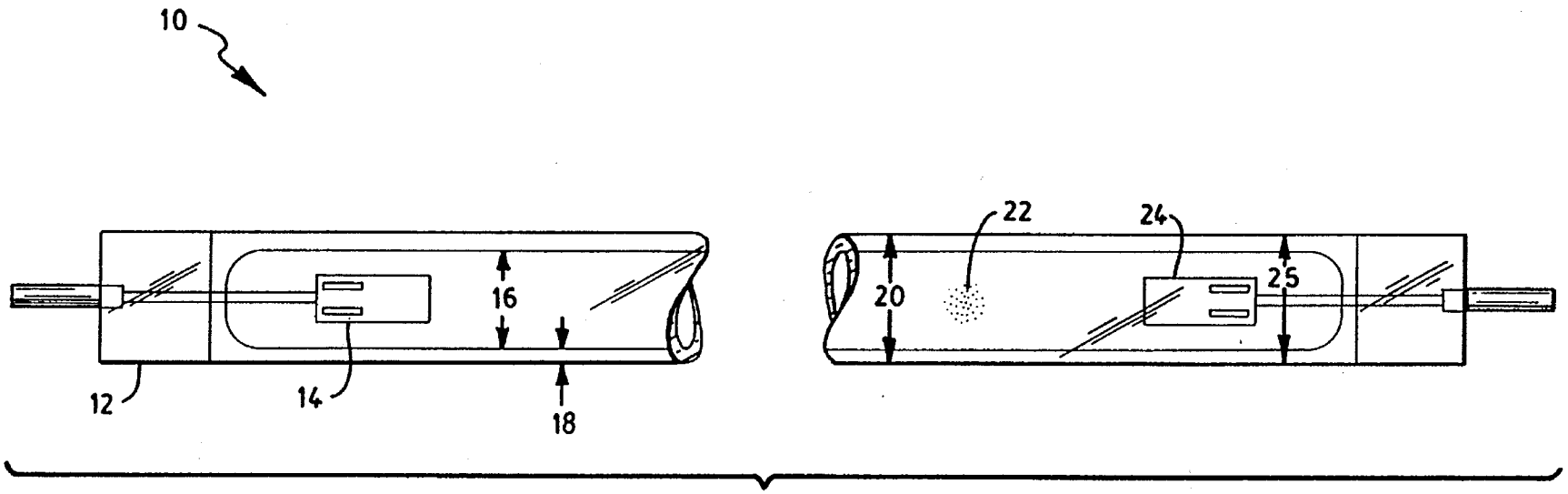
FIG. 1 shows a view, partially broken away of a preferred embodiment of a neon vehicle stop lamp.

FIG. 1 shows a preferred embodiment of a neon vehicle stop lamp, partially broken away. The neon stop lamp 10 for a vehicle is assembled from a tubular envelope 12, a first electrode 14, a neon gas fill 22, and a second electrode 24.

The tubular envelope 12 may be made out of hard glass or quartz to have the general form of an elongated tube. The selection of the envelope material is important in the preferred embodiment. Common neon sign lamps are low pressure, and low intensity discharges. The envelope tubes are made from lead, or lime glasses that are easily formed into the curved text or figures making the desired sign. The bent tubes are then filled and sealed. These glasses if operated at the higher temperatures of a more intense discharge emit the lead, or other chemical species into the enclosed volume. The glass is then devitrified, or stained, or the gas chemistry is changed resulting in a lamp color change. On the other hand, using pure quartz is not acceptable, since pure quartz has a crystal structure that allows neon to penetrate the quartz. The resulting neon leakage depends on the lamp temperature, and gas pressure, so for a higher pressure lamp, the neon leaks faster, resulting in a pressure and color change. There are additional optical and electrical changes that occur as the neon leaks. The preferred glass therefore does not devitrify, or outgas at the temperature of operation, and also substantially blocks leakage of neon through the envelope wall. One suitable glass is an alumina silicate glass, available from Corning Glass Works, and known as type 1724. The 1724 hard glass is believed to nearly optimally stop neon loss.

The envelope 12's inside diameter 16 may vary from 2.0 to 10.0 millimeters, with the preferred inside diameter 16 being about 3.0 millimeters. The inside diameter is relevant to lamp operation. If the inside diameter is small, for example, less than one or two times the mean free path of a neon ion at temperature of operation, then the wall then acts to absorb all of the preplasma energy. The voltage necessary to start, and sustain the lamp then becomes excessive. If the wall is larger, for example many times the mean free path distance of a neon ion, then neon ions can wander from the plasma core long enough to emit additional frequencies. The wall is then not absorbing the remaining emissions, and not acting to quench secondary emissions (glow). The preferred envelope wall thickness 18 may vary from 1.0 to 3.0 millimeters with a preferred wall thickness 18 of about 1.0 millimeter. The outside diameter 25 then may vary from 4.0 millimeters to 16 millimeters with a preferred outside diameter 20 of 5.0 millimeters. Tubular envelopes have been made with overall lengths from 12.7 centimeters to 127 centimeters (5 to 50 inches). The overall length is thought to be a matter of designer choice.

At one end of the tubular envelope 12 is a first sealed end. The first sealed end entrains the first electrode 14. The preferred first sealed end is a press seal capturing the first electrode 14 in the hard glass material. Positioned at the opposite end of the tubular envelope 12 is a second sealed end. The second sealed end may be formed to have substantially the same structure as the first seal, capturing a similarly formed second electrode 24.

Electrode efficiency, and electrode durability are important to overall lamp performance. The preferred electrode is distinctive in having an emissivity that is expected to operate at a high temperature for a long lamp life. A molybdenum rod type electrode may be formed to project into the enclosed envelope volume, with a cup positioned and supported around the inner end of the electrode rod. The cup may be formed from molybdenum, nickel or tantalum rolled in the shape of a cylinder. The Applicant's prefer a tubular metal section. The cup may be easily formed by crimping or welding the metal tube to the electrode rod. Tantalum is believed to have the greatest durability, while nickel has been the easiest to work for testing purposes. Molybdenum is believed to be a reasonable commercial choice.

The region between the electrode tip and the inner wall of the cup may be coated or filled with an electrically conductive material that preferably has a lower work function than does the cup. The fill material is preferably an emitter composition having a low work function, and may also be a getter. The preferred emitter is an alumina and zirconium getter material, known as Sylvania 8488. This material is formed as a water and acetone slurry with about four (4%) weight percent alumina powder, thirty-six (36%) weight percent zirconium, and fifteen (15%) weight percent binder. The nickel cup surrounds the emitter tip, and extends slightly farther, perhaps 2.0 millimeters, into the tubular envelope than does the inner most part of the electrode rod, and the emitter material. Emitter material, or electrode material that might sputter from the emitter tip tends to be contained in the extended cup.

The preferred gas fill 22 is ultra pure, research quality neon. Applicants have found that purity of the fill, and cleanliness of the lamp are important in achieving proper lamp color. Similarly, no mercury is used in the preferred lamp. While mercury reduces the necessary starting voltage in a discharge lamp, mercury also adds a large amount of blue, and ultraviolet light to the output spectrum. Applicants have found that even a few parts per million of mercury affect the color of the lamp, making it difficult to meet the SAE requirements for red. Mercury based lamps are also difficult to start in cold environments, an undesirable feature for a vehicle lamp. Mercury is also felt to be a possible environmental hazard that for prudence should be minimized or eliminated where practical. Similarly other gases may be included in the lamp, but it has generally been found that other gases color the spectrum and usually move the color coordinates away from the SAE region. Nitrogen in small quantities, for example 1 percent or less, is known to lower the necessary operating voltage. In general small quantities of other materials may be included, but this is not preferred.

Figure 2:
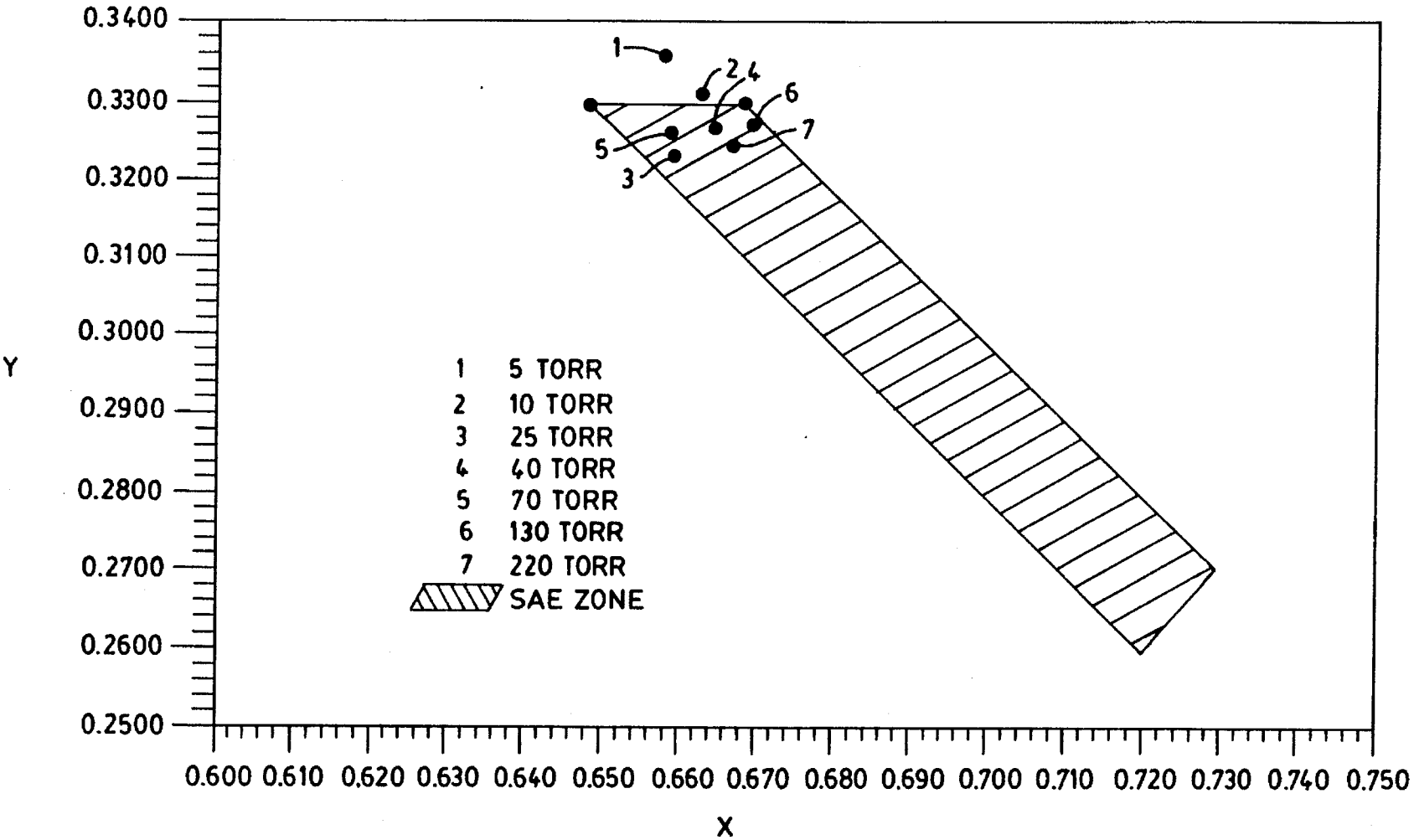
FIG. 2 shows a chart of the acceptable SAE red region and neon lamp chromaticities at different pressures.

The gas fill 22 pressure affects the color output of the lamp. Higher fill pressures tend to quench emissions subsequent to the initial emission. The chromaticity of the output light is then more likely to be that first stimulated by the selected pulse width and frequency. Any lingering glow, and the variety of emissions therefrom are then minimized. FIG. 2 shows a chart of neon chromaticities at different pressures. Increasing pressure shortens the time between atomic collisions, and thereby shifts the population of emitting neon species more to the red. The SAE requirements are outlined be the quadrilateral 26 of FIG. 2. The four corner coordinates of the SAE red region are (0.65, 0.33), (0.67, 0.33), (0.72, 0.26), and (0.73, 0.27). By adjusting the pressure, one can then affect the color emission. At pressures below 10 torr, the chromaticity is just outside the SAE range. Applicants believe that any pressure above 10 torr is then possibly useful in generating the required SAE red. At 70 torr the lamp tends to give the best chromaticity figures of (0.6622, 0.3259). While nearly as good are those for neon at 220 torr, (0.6696, 0.3243) with decreasing pressure the emitted light tends to be orange. Chromaticities for other tested pressures are listed below:

| PRESSURE | X | Y |
|---|---|---|
| 5 torr | 0.6596 | 0.3361 |
| 10 torr | 0.6652 | 0.3304 |
| 25 torr | 0.6623 | 0.3238 |
| 40 torr | 0.6679 | 0.3267 |

-continued

| PRESSURE | X | Y |
|---|---|---|
| 70 torr | 0.6622 | 0.3259 |
| 130 torr | 0.6717 | 0.3276 |
| 220 torr | 0.6696 | 0.3243 |

The neon gas fill 22 may have a pressure from 10 torr to 220 torr. At pressures of 50 torr or less, the electrodes tend to sputter, discoloring the lamp, reducing functional output intensity, and threatening to crack the lamp by interacting the sputtered metal with the envelope wall. This affect of pressure on lamp durability depends in part on lamp length (arc gap). Conversely, as the neon pressure increases, the ballast must provide more power to move the electrons through the neon, and the lamp becomes less economical. Lamps above 300 torr of neon are felt to be less practical due to the increasing hardware and operating expense. The preferred pressure is then above 50 torr, and below 300 torr.

Figure 3:
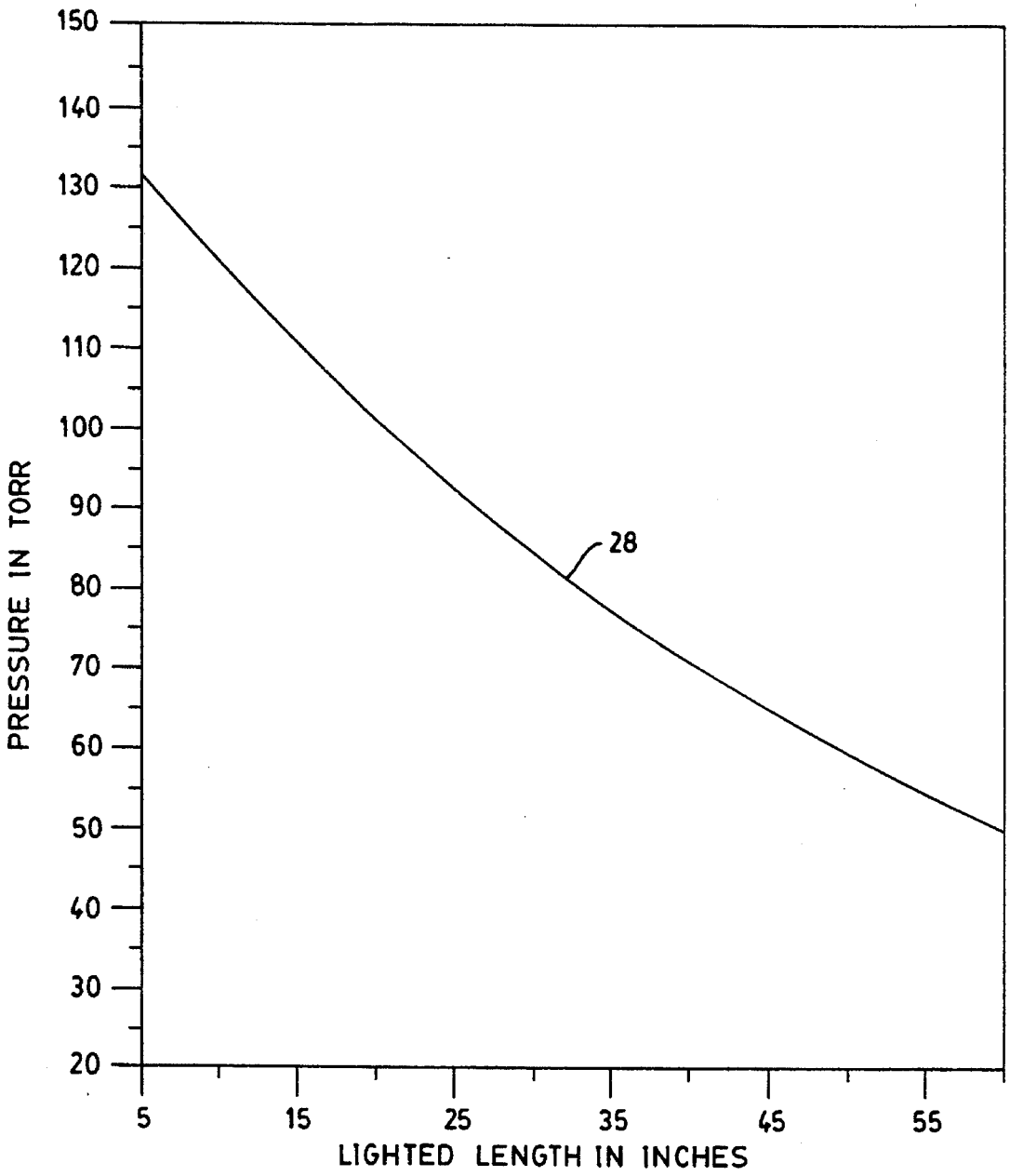
FIG. 3 shows a calculated best fit curve for neon lamps giving a constant life line for neon lamps at various lengths and pressures.

FIG. 3 shows a calculated best fit curve for neon lamps giving a constant life line for neon lamps at various lengths and pressures. The line 28 indicates a calculated best curve fit for a set of lamps with approximately the same tested lamp life. Lamps along line 28, having the lengths and pressures indicated, were tested and found to survive 2000 hours, and 800,000 lamp starts. Similar constant lamp life lines exist for other lamp life criteria. The lamps in the region below and to the left of the line 28 (lower pressure or shorter length) had electrodes that sputtered more quickly. The lamps in the region above and to the right of line 28 (higher pressure or longer length) required more power, and therefore heavier and more expensive ballasts. The preferred neon lamp pressures and lengths then fall along line 28, so lamp life is achieved efficiently. For example, one preferred lamp has a pressure of about 70 torr, and length of 1000 millimeters (39.4 inches), another had a pressure of about 100 torr, and length of 470 millimeters (18.5 inches), and a third had a pressure of about 120 torr, and length of 254 millimeters (10.0 inches).

The operating lamp voltage is chosen according to the lamp length. Theoretically the electric field over the arc gap length must be sufficient to accelerate emitted electrons to the ionization potential of neon (21 electron volts). In practice there are losses, so the field must be somewhat higher. The disclosed neon lamps are generally operated at 40 to 70 volts RMS per centimeter of electrode separation, and at about 0.5 to 5.0 milliamps RMS per centimeter of electrode separation. The best value is thought to be about 2.2 milliamps RMS per centimeter of electrode separation. The lamp wattage may range from about 5.0 to about 50.0 watts, with the longer length lamps having the greater wattages. Possible lamps would then include:

| Lamp 1 | Lamp 2 | Lamp 3 |
|---|---|---|
| 10 inches | 18.5 inches | 39.4 inches |
| 25.4 cm | 47 cm | 100 cm |
| 120 torr | 100 torr | 70 torr |
| 55.8 milliamps | 103.4 milliamps | 220.0 milliamps |
| 1016–1778 volts | 1880–3290 volts | 4000–7000 volts |

Figure 4:
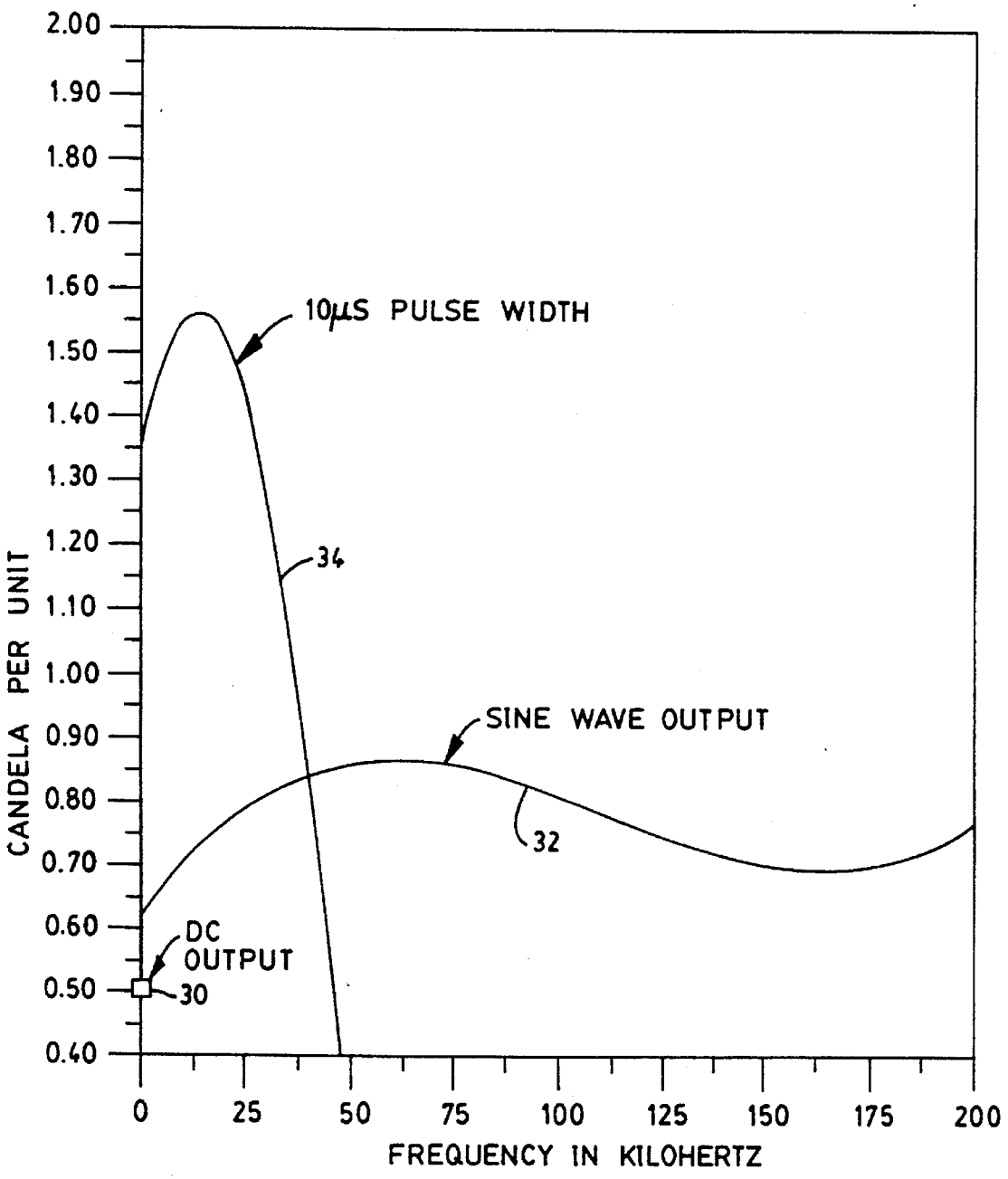
FIG. 4 shows calculated best curve fits of candelas per watt produced at different frequencies for three wave forms.

The method of lamp operation is also relevant to the efficiency of the lamp and the chromaticity of the emitted light. FIG. 4 shows calculated best curve fits of candelas per watt produced at different frequencies for three wave forms. In each case, data was collected by testing the same lamp for the different power forms. Only the method of operation was changed. For direct current operation, point 30, the lamp produced about 0.5 candelas per watt. However, the neon lamp operating by continuous wave, produces light at about seven to nine lumens per watt, and runs hot. Expensive heat protections would then have to be built into the lamp housing.

When operated with a sine wave variation of direct current, line 32, the candelas per watt were increased over all frequencies. The maximum efficiency for sine wave operation was found to be at about 60 kHz, where the calculated best curve fit shows the neon lamp produced about 0.85 candelas per watt. Actual data showed 0.91 candelas per watt at this specific point. When operated with a pulse width of 10 microseconds, and a rate of about 15 kHz, the calculated best curve fit for the data produced line 34. The best curve fit for the data shows the neon lamp producing a peak value of about 1.55 candelas per watt. This is an artifact of the curve fit. The best actual data points were at 12 kHz and at 17 kHz, where 1.55 candelas per watt were produced. The curve fit shows an increase of 210 percent for the best pulsed value over the direct current operation, and an 82 percent increase over the best sine wave operation. The best actual data points showed an increase of about 70 percent of the pulsed method over the sine wave method. Operation with a pulse width of 10 microseconds at frequencies up to about 40 kHz is therefore believed to be more efficient than the best continuous wave operation at about 60 kHz. Applicants have found that by operating in a pulsed mode, the lamp can be made to produce 1.55 candelas per watt, a 70 to 82 percent increase in efficiency, over a 60 kHz continuous wave power source, thereby allowing cooler operation. Pulsed operation can be an efficient method of driving a neon lamp.

In a similar fashion, the pulse width has been studied and found to shift the lamp color, and increase efficiency. When energized, neon can produce a discharge with a red to orange radiation, primarily in the range of about 590 to 670 nanometers, due to relaxation radiation from the first and second energy levels of neon. Applicants have found that pulsing the neon lamp affects the output spectrum. Applicants operated the neon lamp with pulsed direct current having a pulse rates varying from 1 to 50 kHz. While the most efficient lamp operation is achieved at about 10 kHz, this is in the range of human hearing. While the lamp itself does not generate sound, a ballast or other system component. A rate of 20 kHz or higher may therefore be preferred so the whole system operates above most human hearing, but still close to the maximum candela efficiency.

Pulsed direct current stimulates the neon to several energy levels. The most prominent emission lines are at 703 and 724 nanometers, which approximate the transitions between the 3p to 3s energy levels of neon. The 703 and 724 nanometer wavelengths are less useful in meeting the SAE standard, but because of the energy splitting of the electron and orbital angular momentums, two additional transitions are available. The additional transitions produce emissions at 638 and 693 nanometers, which are more useful in producing the desired SAE red. The four transitions all terminate on the first excited level of neon. Proper selection of the pulse width can then enhance the color output. For proper SAE color production, the Applicants prefer a pulse width of about 10 microsecond. A shorter pulse width tends to move the lamp color to the orange. A longer pulse width favors the higher energy transition populations 703 and 724, which tends to move the lamp color to a deeper, less efficient red. By varying the pulse width, the lamp color can be shifted from a reddish orange to a deep red. While a continuous wave electric field may be used, it is less efficient as it tends to excite the wrong species of emission, and uses energy for the whole excitation cycle. It is therefore more efficient both for candela and SAE red color production to apply just the power that excites the desired emission species, and to do so just as long as is needed to bring the neon atoms up to the best level of excitation. Energy may then be saved in each cycle, as the properly excited neon ions are left to collide and emit the desired red frequency.

Pulse shape is also relevant to the lamp output. The preferred pulse has a sharp onset. A triangle wave has been found to be better than a sine wave. A square wave has been found to be better than a triangle wave. The sharp onset seems to result in a narrower emission spectrum. Similarly, a fast termination limits lingering stimulation that results in a broader emission spectrum.

Figure 5:
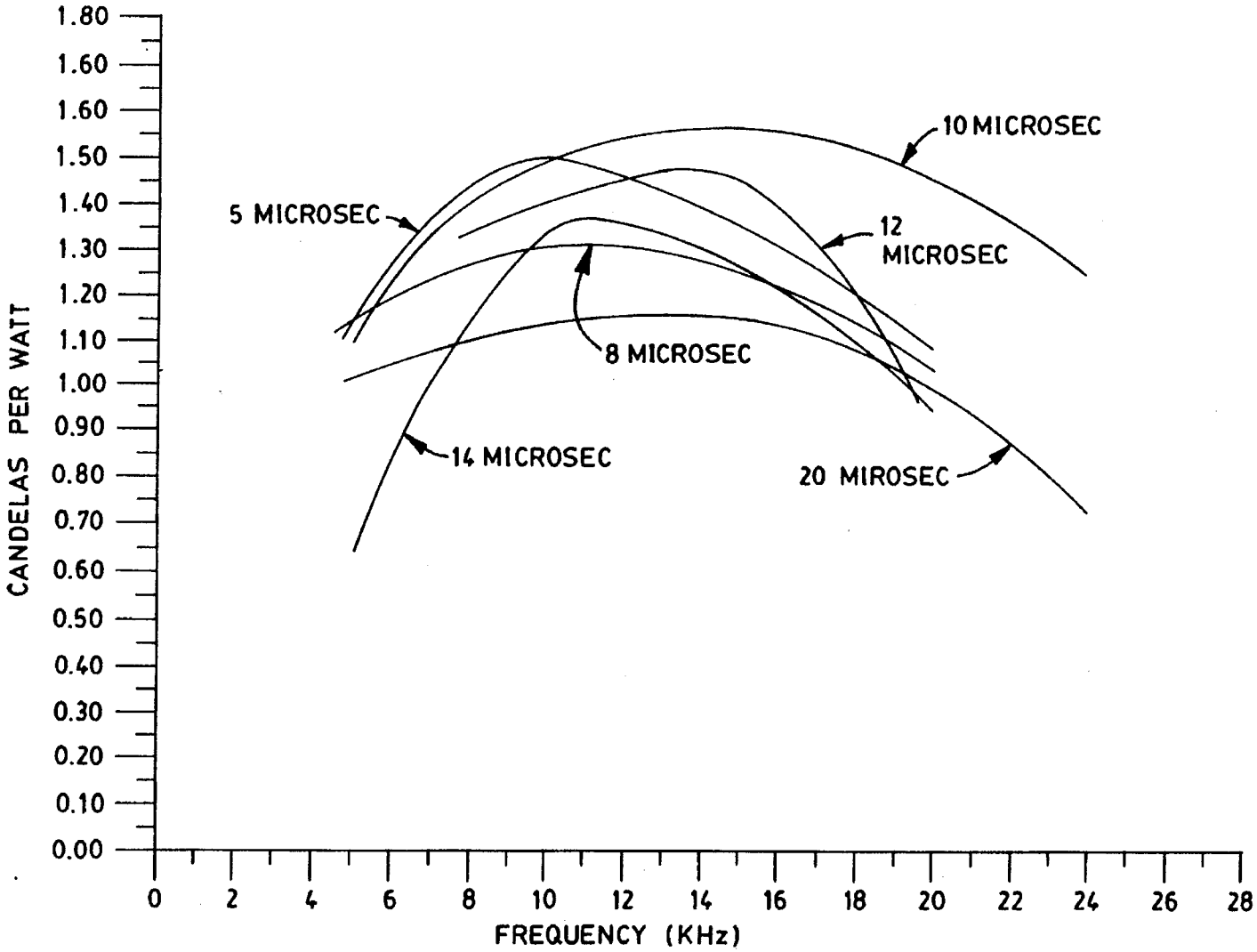
FIG. 5 shows calculated best curve fits of candelas per watt for a lamp operated at various pulse widths, and various frequencies.

FIG. 5 shows calculated best curve fits of candelas per watt for a lamp operated at various pulse widths, and various frequencies. Pulse widths of 5, 8, 12, 14 and 20 microseconds were tested over a range from 5 kHz to 24 kHz. A pulse width of 10 microseconds was tested over a range from 5 kHz to 50 kHz. Again, the lamp structures, and neon pressure were the same in earth case. The pulses were generated by laboratory type equipment, and as of yet no particular circuit design has been chosen by the Applicants. In general the curves show a decline in candelas as the frequency drops below 9 kHz, and when the frequency exceeds 17 kHz. The curves also show that there is increasing efficiency as the pulse width moves up from 5 microseconds to 10 microseconds. There is then a decline from maximum efficiency, but there is still improvement over continuous wave operation as the pulse width increases from 10 microseconds to 20 microseconds. The most efficient method of operation is then thought to be to supply pulsed power at a frequency from about 9 kHz to about 17 kHz, with a pulse width of about 9 to 14 microseconds. The best point of operation for candela production is believed to be with a 10 microsecond pulse width at 15 kHz.

Figure 6:
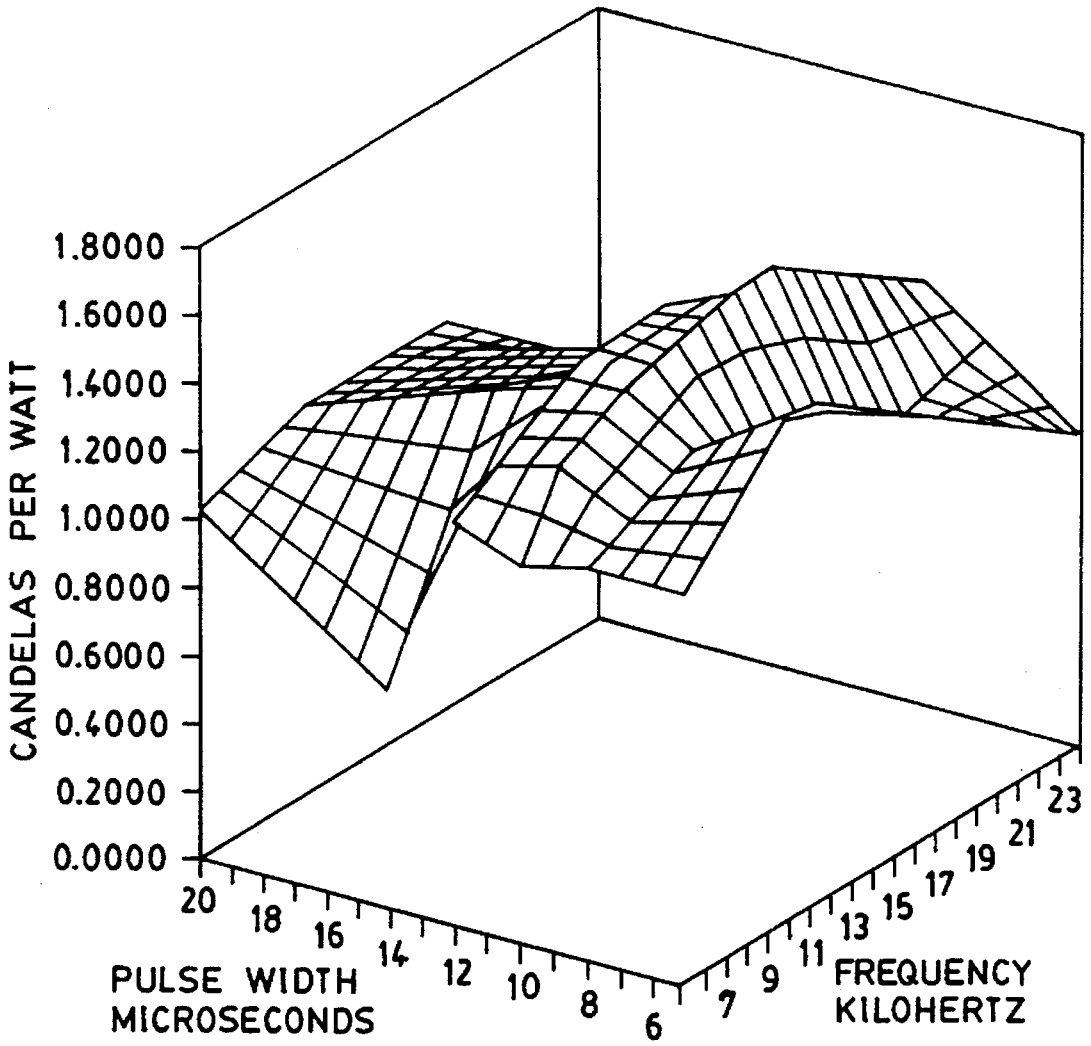
FIG. 6 shows three dimensional plot of candelas per watt for a lamp operated at various pulse widths, and various frequencies.

FIG. 6 shows a three dimensional plot of candelas per watt for a lamp operated at various pulse widths, and various frequencies. Points between actual data points have been linearly interpolated. In general there is a peak in the pulse width region from about 5.0 to 20.0 microsecond, and in the frequency range from about 5.0 to 24.0 kilohertz. It is understood collected data may vary due to individual lamp performance, experimental error and the like. More specifically, a crest in the plot can be seen running along the 10.0 microsecond pulse width line, peaking in the 8.0 to 12.0 kilohertz frequency range. A portion of another peak may be seen along the 5.0 microsecond pulse width line, peaking in the 5.0 to 12.0 kilohertz frequency range.

In summary the best pressure to meet the SAE chromaticity is from 50 to 220 torr, depending on the lamp length. The best pressure for electrical efficiency is as small as possible, while the best pressure for sputtering control is greater than 50 torr and more preferably 70 torr. The best frequency for candela efficiency is from 12 to 17 kHz. While the best practical frequency is just above the limit of most human hearing or about 20 kHz. The best pulse width for candela efficiency is from 10 to 20 microseconds. The preferred neon lamp then has a 70 torr or higher of neon, and is operated at from 12 to 17 kHz for pure efficiency, or at 20 kHz for efficient and non-audible operation, with a pulse width from 10 to 20 microseconds.

In a working example some of the dimensions were approximately as follows: The tubular envelope was made of 1724 hard glass, and had a tubular wall with an overall length of 50 centimeters, an inside diameter of 3.0 millimeters, a wall thickness of 1.0 millimeters and an outside diameter of 5.0. The electrodes were made of molybdenum shafts supporting crimped on nickel cups. Each nickel cup was partially filled with an alumina and zirconium getter material, known as Sylvania 8488. The molybdenum rod had a diameter of 0.508 millimeter (0.020 inch). The exterior end of the molybdenum rod was butt welded to a thicker (about 1.0 millimeter) outer rod made of nickel coated steel. The inner end of the outer rod extended into the sealed tube about 2 or 3 millimeters. The thicker outer rod is more able to endure abusive coupling, than the thinner inner electrode support rod. The cup lip extended about 2.0 millimeters farther into the envelope than did the rod. The gas fill was pure neon, and had a pressure ranging from 5 to 220 torr.

The pulsed operation of the neon lamp then produced efficiency gains of 82% greater than for 60 kHz continuous wave power, and additionally produced light that met the SAE color requirement. The disclosed operating conditions, dimensions, configurations and embodiments are as examples only, and other suitable configurations and relations may be used to implement the invention. While there have been shown and described what are at present considered to be the preferred embodiments of the invention, it will be apparent to those skilled in the art that various changes and modifications can be made herein without departing from the scope of the invention defined by the appended claims. In particular, small quantities of other materials, such as mercury and other rare gases may be included in the lamp, particularly where the resulting color change is acceptable.

What is claimed is:

1. A method of operating a tubular neon gas discharge lamp as a vehicle red lamp, the lamp having an inside diameter less than or equal to 10 millimeters, with a neon fill, at a pressure of more than 10 torr and having no mercury, being substantially pure with little or no argon, krypton and xenon, and having two electrodes in contact with the neon, the method comprising:

supplying pulses of direct current at sufficient field strength to induce electrons to ionize neon, the pulses having a time duration of from 5 to 20 microseconds at a delivery rate of from 5 to 50 kilohertz, so that the pulse duration and pulse frequency enhance the relative population states of the ionized neon resulting in relatively redder emissions with respect to the relative population states of the ionized neon resulting in relatively oranger emissions to thereby emit light having overall chromaticity coordinates falling within the red region defined by the chromaticity coordinates of (0.65, 0.33), (0.67, 0.33), (0.72, 0.26), and (0.73, 0.27).

2. The method in claim 1, wherein the frequency is from 9 to 17 kilohertz.

3. The method in claim 1, wherein the frequency is above 20 kilohertz.

4. The method in claim 1, wherein the pulse width is from 8 to 14 microseconds.

5. The method in claim 4, wherein the pulse width is from 8 to 12 microseconds.

6. The method in claim 1, wherein the neon fill pressure is 50 torr or more.

7. The method in claim 1, wherein the pulses have a sharp onset.

8. The method in claim 1, wherein the pulses have a rapid termination.

9. The method of operation in claim 1, wherein the pulses have a substantially square wave form.

10. An method of operating a tubular neon rare gas discharge lamp as a vehicle red lamp, the lamp having a tube diameter less than 5 millimeters, and a neon pressure from 50 to 220 torr, and having no mercury, and being substantially pure with little or no argon, krypton and xenon, comprising the steps of:

a) supplying pulses of direct current at sufficient field strength to induce electrons to ionize neon, with a pulse time duration from 8 to 14 microseconds, b) at a frequency from 9 to 24 kilohertz, and c) such that the pulse duration and pulse frequency induce the production of red light having chromaticity coordinates falling within the red region defined by the chromaticity coordinates of (0.65, 0.33), (0.67, 0.33), (0.72, 0.26), and (0.73, 0.27).

11. An method of operating a tubular neon gas discharge lamp as a vehicle red lamp, the lamp having a tube diameter less than 5 millimeters, and a neon pressure of about 70 torr, and being substantially pure, to produce a red emission within the SAE automotive requirement comprising the steps of:

a) supplying pulsed direct current at sufficient field strength to induce electrons to ionize neon, with a pulse time duration of about 10 microseconds, b) at a frequency of about 20 kilohertz, and c) such that the pulse duration and pulse frequency induce the production of red light having chromaticity coordinates falling within the red Legion defined by the chromaticity coordinates of (0.65, 0.33), (0.67, 0.33), (0.72, 0.26), and (0.73, 0.27).

12. A method of operating a tubular neon gas discharge lamp as a vehicle red lamp, the lamp having a neon fill at a pressure equal to or greater than 10 torr, and having no included mercury, and being substantially pure with little or no argon, krypton and xenon, comprising: supplying current pulses at sufficient field strength to induce electrons to ionize neon, having a pulse time correlated to a desired emission frequency of the neon gas, and at a delivery frequency chosen to maximize lamp efficiency such that the pulse duration and pulse frequency induce the production of red light having chromaticity coordinates falling within the red region defined by the chromaticity coordinates of (0.65, 0.33), (0.67, 0.33), (0.72, 0.26), and (0.73, 0.27).

13. A method of operating a tubular neon gas discharge lamp as a vehicle red lamp, the lamp having a neon fill at a pressure equal to or greater than 10 torr, and having no included mercury, and being substantially pure with little or no argon, krypton and xenon, comprising: supplying current pulses at sufficient field strength to induce electrons to ionize neon, having a pulse time chosen to maximize the lamp efficiency for a particular desired emission frequency, and at a delivery frequency chosen to maximize lamp efficiency given the chosen pulse size such that the pulse duration and pulse frequency induce the production of red light having chromaticity coordinates falling within the red region defined by the chromaticity coordinates of (0.65, 0.33), (0,67. 0.33), (0.72, 0.26), and (0.73, 0.27).

14. The method in claim 13, wherein the chosen delivery frequency is above the maximal value of normal human hearing.

15. The method in claim 13, wherein the neon gas discharge lamp has a pressure of 50 torr or more.

16. The method in claim 13, wherein the pulses of direct current have a duration of from 5 to 20 microseconds.

17. The method of claim 13, wherein the delivery frequency is from 5 to 50 kilohertz.

18. The method in claim 13, wherein the pulses have a sharp onset.

19.The method in claim 13, wherein the pulses have a rapid termination.

20. The method of operation in claim 13, wherein the pulses have a substantially square wave form.

21. A method of operating a tubular neon gas discharge lamp as a vehicle red lamp, the lamp having a tube diameter less than 5 millimeters, and a neon fill of substantially pure neon at a pressure of approximately 70 torr, the method comprising: supplying current pulses at a field strength greater than the ionization potential of neon to thereby cause the neon to ionize, the pulses having a pulse duration time of approximately 10 microseconds to stimulate emission of the 703 and 724 nanometer wavelength light, and delivering the pulses at a convenient frequency to thereby produce a red emission complying with SAE vehicle standards such that the pulse duration and pulse frequency induce the production of red light having chromaticity coordinates falling within the red region defined by the chromaticity coordinates of (0.65, 0.33) (0,67, 0.33), (0.72, 0.26), and (0.73, 0.27).

* * * * *